United States Patent [19]

Taneichi

[11] 4,166,365

[45] Sep. 4, 1979

[54] APPARATUS FOR LIQUEFYING REFRIGERANT AND GENERATING LOW TEMPERATURE

[76] Inventor: Sanji Taneichi, 24-16 8-chome, Higashisuna, Koto-ku, Japan

[21] Appl. No.: 839,641

[22] Filed: Oct. 5, 1977

[30] Foreign Application Priority Data

Oct. 9, 1976 [JP] Japan ..... 51-121468
Oct. 9, 1976 [JP] Japan ..... 51-121469

[51] Int. Cl.[2] ..... F25B 19/00
[52] U.S. Cl. ..... 62/514 R
[58] Field of Search ..... 62/500, 514 R, 514 JT

[56] References Cited

U.S. PATENT DOCUMENTS

| | | | |
|---|---|---|---|
| 3,353,371 | 11/1967 | Hammons et al. | 62/514 JT |
| 3,795,116 | 3/1974 | Burnier et al. | 62/514 JT |
| 3,800,552 | 4/1974 | Sollami et al. | 62/514 JT |
| 3,885,939 | 5/1975 | Markum | 62/514 JT |
| 4,080,802 | 3/1978 | Annable | 62/514 JT |

*Primary Examiner*—Ronald C. Capossela
*Attorney, Agent, or Firm*—Martin A. Farber

[57] ABSTRACT

Disclosed herein is an apparatus for liquefying refrigerant and generating a low temperature in which a low temperature state is provided by the utilization of the refrigerant adiabatic expansion. The refrigerant is jetted into an expansion chamber through a valve, and is subjected to adiabatic expansion thereby to provide a low temperature state in the expansion chamber. The refrigerant thus placed in the low temperature state and liquefied is mixed with the refrigerant in a tank, as a result of which the temperature of the refrigerant in the tank is decreased. The refrigerant is intermittently jetted into the expansion chamber at predetermined time intervals.

5 Claims, 5 Drawing Figures

APPARATUS FOR LIQUEFYING REFRIGERANT AND GENERATING LOW TEMPERATURE

BACKGROUND OF THE INVENTION (1) Field of the Invention

This invention relates to an apparatus for liquefying refrigerant and generating a low temperature state in which the adiabatic expansion of refrigerant is utilized for providing a low temperature state.

(2) Description of the Prior Art

There are many fields requiring low temperatures as in industrial processes such as refrigeration, cold storage, air conditioning. In this connection, a so-called compression type refrigerator is extensively employed in which a refrigerant circulating cycle consisting of compression, condensation, expansion and evaporation is effected to provide a low temperature. However, it should be noted that in the refrigerator of this type a considerably high pressure is developed during the compression; and accordingly the refrigerator suffers from disadvantages that it must have a mechanical strength strong enough to withstand the high pressure, which leads to increase in size of the refrigerator and to increase in manufacturing cost thereof. In addition, the large noise of the compressor is another problem to be solved.

SUMMARY OF THE INVENTION

Accordingly, an object of the invention is to eliminate all of the above-described difficulties accompanying the prior art.

More specifically, an object of the invention is to provide an apparatus for liquefying refrigerant and generating a low temperature state, which is capable of miniaturizing the apparatus and meeting the demand for material saving, and which is low in manufacturing cost.

In order to achieve the foregoing object of the invention, provided is an apparatus for liquefying refrigerant and generating a low temperature state in which, according to the invention, refrigerant is jetted into an expansion chamber through a throttle valve and a refrigerant flow control valve opened and closed at predetermined time intervals, and when the pressure is decreased, the refrigerant liquid in a refrigerant tank is cooled.

The novel features which are considered characteristic of this invention are set forth in the appended claims. This invention itself, however, as well as other objects and advantages thereof will be best understood by reference to the following detailed description of illustrative embodiments, when read in conjunction with the accompanying drawings, in which like parts are designated by like reference characters.

DETAILED DESCRIPTION OF THE INVENTION

This invention will be described in detail with reference to its one example shown in the accompanying drawings.

Figure 1:
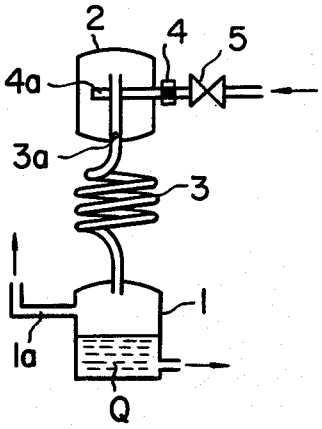
FIG. 1 is an explanatory diagram showing an apparatus for liquefying refrigerant and generating a low temperature state according to this invention.
Figure 4:
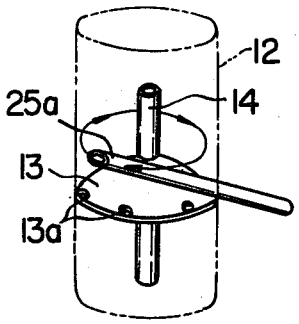
FIG. 4 is a perspective view illustrating relationships between a separating plate separating an expansion chamber from a refrigeration tank, and a jet nozzle.
Figure 5:
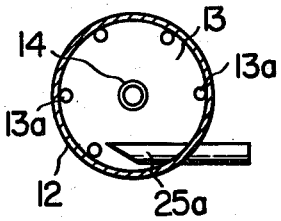
FIG. 5 is a sectional explanatory diagram showing the expansion chamber and the jet nozzle.

In FIG. 1, reference numeral 1 designates a refrigerant tank for storing refrigerant Q, and reference numeral 2 designates a expansion chamber provided above the tank 1. The expansion chamber 2 is in the form of a cylinder erected. The refrigerant tank 1 is communicated with the expansion chamber 2 through a pipe 3 which is formed in spiral state. The pipe's length is so determined as to provide a necessary temperature gradient between the tank 1 and the chamber 2. In this case, the pipe 3 is allowed to appear at the central portion of the chamber by penetrating the central portion of the bottom of the cylindrical expansion chamber 2. Several holes, for instance three small holes **3*a*, are provided in the wall of the end portion of the pipe thus protruded in the chamber. These small holes 3*a* are to introduce the refrigerant which is liquefied when the refrigerant gas described later is jetted, to the refrigerant tank 1 through the pipe 3**.

Figure 2:
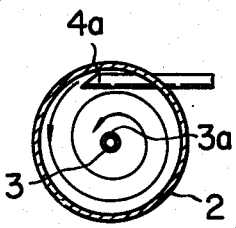
FIG. 2 is a sectional explanatory diagram for a description of relationships between an expansion chamber and a jet nozzle.

On the other hand, a control valve (or a nozzle) 4 adapted to jet the refrigerant gas into the chamber thereby to expand the same is provided on one side of the expansion chamber 2. More specifically, the valve 4 is arranged in such a manner that as shown in FIG. 2 its jet nozzle **4*a* protruded into the expansion chamber 2, and its tip end is cut obliquely so that the cut surface confronts the inner wall of the chamber. In other words, the arrangement of the valve is such that when the refrigerant gas is jetted, the jetted refrigerant gas is allowed to flow along the inner wall of the expansion chamber 2 thereby to form a so-called eddy current. Furthermore, a refrigerant flow control valve 5 is provided at the inlet of the control valve 4. The refrigerant flow control valve 5 is operated (opened and closed) at predetermined time intervals to intermittently supply the refrigerant gas. The control valve 5 is an inlet for the refrigerant gas to be liquefied, and is adapted to receive the refrigerant gas, 40°–50° C. and 5–10 kg/cm$^2$, from the preceding process in the refrigeration cycle. The refrigerant gas to be liquefied is for a cooler, it should be somewhat air-cooled by means of a radiator. As the operation time interval of the control valve 5** is affected by the opening degree of the nozzle, the temperature and pressure of the refrigerant gas before jetting, and the pressure thereof after expansion, it should be suitably determined according to these conditions.

In FIG. 1, reference numeral **1*a* is intended to designate a suction inlet which is provided on the tank 1 so that the refrigerant gas in the tank 1 is sucked by a pump in the predetermined process in the refrigeration cycle. While the pipe 3 shown in FIG. 1 is spiral, it should be noted that the configuration of the pipe 3 is not limited thereto or thereby; that is it may be in zig-zag state for instance. However, to smoothly introduce the refrigerant liquefied into the tank 1, it is necessary for the pipe to have a gradient so that the tank 1** is on the lower level.

Now, the refrigerant gas liquefying action of the apparatus thus organized will be described. The refrigerant gas to be liquefied which is in the liquefaction process after passing through the predetermined processes in the refrigeration cycle; that is, the refrigerant gas which has reached the inlet of the control valve 5 is at a temperature of 4° to 50° C. and at a pressure of 5 to 10 kg/cm$^2$. This refrigerant gas is jetted through the control valve 4 into the expansion chamber 2 by the intermittent operation of the control valve 5, as a result of which the pressure and temperature of the refrigeration gas are reduced through a so-called adiabatic expansion. In this operation, the refrigerant jetted from the jet nozzle 4*a* forms an eddy current along the inner wall of the expansion chamber 2, as a result of which the pressure of the chamber 2 is decreased at the central portion thereof but is increased at the peripheral portion thereof. In jetting the refrigerant, its temperature is decreased through the adiabatic expansion, and the refrigerant is therefore liquefied. The refrigerant thus liquefied is allowed to flow down along the inner wall of the expansion chamber 2 and to flow into the tank 1 through the small holes 3*a* and along the pipe 3. Similarly, the refrigerant gas is allowed to flow into the refrigerant tank 1 through the pipe 3. As the length of the pipe 3 is so determined as to have the necessary temperature gradient as was described before, when the refrigerant gas passes through the pipe 3, it is liquefied and is allowed to flow down into the refrigerant tank 1. Thus, liquefaction of the refrigerant gas has been achieved. The pressure and temperature of the refrigerant liquid Q in the refrigerant tank 1 are approximately 2 to 3 kg/cm$^2$ and 150° C., respectively.

As is apparent from the above description, according to this invention, the adiabatic expansion is effected by intermittently jetting the refrigeration gas to be liquefied by means of the control valve operated at the predetermined time intervals and the control valve (nozzle), and thereafter the partly liquefied refrigerant is merely allowed to pass through the pipe whose length is predetermined so as to provide the necessary temperature gradient. Accordingly, forcible cooling is unnecessary, and the construction of the apparatus can be considerably simplified, which leads to miniaturization of the apparatus. As a result, the space occupied by the apparatus can be smaller, and therefore it can be said that the apparatus is economical. Furthermore, the sound caused during the operation thereof is relatively small. If the technical concept of the invention is applied to the refrigeration cycle, it can greatly contribute to the miniaturization of the whole apparatus. In addition, the apparatus according to the invention can be employed as the condenser in the conventional cooler.

Another embodiment of the invention will be described with reference to the case where it is incorporated in a low temperature circulation cycle.

Figure 3:
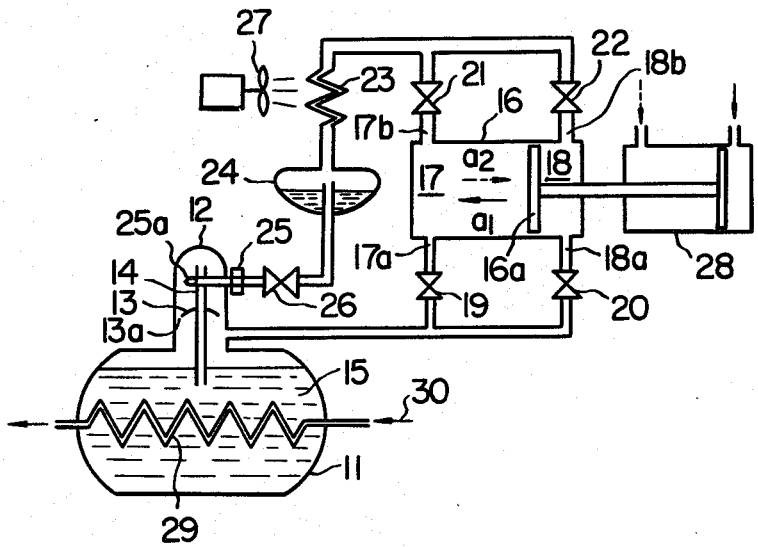
FIG. 3 is an explanatory diagram illustrating the apparatus according to the invention incorporated in a low temperature circulation cycle.

Referring to FIG. 3, reference numeral 11 designates a refrigerant tank for storing, for instance, methyl chloride, above which there is provided a cylindrical expansion chamber 12. The refrigerant tank 11 and the cylindrical expansion chamber 12 preferably forms one unit in order to improve thermal conduction. The outside surface thereof is covered with heat insulating material (not shown) in order to the adiabatic effect. The expansion chamber 12 is separated from the tank 11 by a separating plate 13, but it is communicated through a communicating pipe 14 with the refrigerant liquid 15 in the tank 11. The separating plate 13 is semispherical. The communicating pipe 14 penetrates the central portion of the separating plate 13 and is fixedly secured there. Several small holes 13*a* are provided in the peripheral portion of the separating plate 13. The separating plate 13 is fixedly secured to the inner wall of the expansion chamber 12 in such a manner that its convex surface is directed upward.

Reference numeral 16 designates a pressure reducing chamber, and the spaces 17 and 18 provided on both sides of a piston 16*a* are pressure reducing chambers. The pressure reducing chambers 17 and 18 are provided with suction inlets 17*a* and 18*a* and exhaust outlets 17*b* and 18*b*, respectively. The suction inlets 17*a* and 18*a* are communicated respectively through suction valves 19 and 20 with the space above the refrigerant liquid in the refrigerant tank 11. The exhaust outlets 17*b* and 18*b* are connected respectively through exhaust valves 21 and 22 to the inlet of a heat exchanger 23. Reference numeral 24 designates a pressure cushioning tank connected to the outlet of the heat exchanger 23. Reference numeral 25 designates a throttle valve (or a control valve) adapted to jet the refrigerant from the pressure cushioning tank 24, which is mainly refrigerant in gas state, thereby to reduce pressure. Reference numeral 26 designates a refrigerant flow control valve interposed between the tank 24 and the throttle valve 25. The refrigerant flow control valve is operated (opened and closed) at predetermined time intervals, which are preset so that when the pressure at the inlet of the throttle valve 25 is of the order of 3 kg/cm$^2$, the pressure at the outlet is 0.3 to 0.5 kg/cm$^2$. In general, it is preferable that the pressure difference is large. Therefore, the setting of the time intervals is effected so that the pressure difference is relatively large.

The tip end portion of the jet nozzle 25*a* of the throttle valve 25 is, as shown in FIGS. 2 and 3, cut obliquely. The jet nozzle 25*a* is supported horizontal and adjacent to the inner wall of the expansion chamber 12 in such a manner that the cut surface thereof confronts the inner wall of the expansion chamber 12. Accordingly, an eddy current is caused in the expansion chamber 12 by the refrigerant jetted through the jet nozzle, whereby a pressure difference is caused between the pressure at the central portion of the chamber and that at the peripheral portion thereof. Under a predetermined temperature condition, the refrigerant liquid in the refrigerant tank 11 is sucked upward into the expansion chamber 12 through the communicating pipe 14; that is, a pumping action is effected, by the utilization of this pressure difference. Reference numeral 27 is intended to designate a cooling fan for cooling the above described heat exchanger 23. Reference numeral 28 designates a driving source for the pressure reducing cylinder 16, which is an air cylinder, for instance. The piston rods of the two cylinders 16 and 28 are connected to form one unit. Accordingly, as the piston of the air cylinder 28 reciprocates, the piston 16*a* of the pressure reducing cylinder 16 is reciprocated. Reference numeral 29 designates a heat exchanger through which a secondary refrigerant such as water is allowed to flow. The heat exchanger 29 is provided in the refrigerant liquid 15 of the refrigerant tank 11.

The synchronization of the aforementioned suction valves 19 and 20 and exhaust valves 21 and 22 are effected electrically if they are electromagnetic valves, and are effected mechanically by the use of a link mechanism or a cam mechanism if they are manually operated valves. The operation of the refrigerant flow control valve 26 is associated with the suction and discharge of the refrigerant caused by the pressure reducing cylinder 16. Therefore, the operation of the control valve 26 may be synchronized with the operation of the pressure reducing cylinder 16. This synchronization may be effected either electrically or mechanically.

The operation of the apparatus thus constructed will be described. It is assumed that the piston 16*a* of the pressure reducing cylinder 16 is moved in the direction of the arrow $a_1$ by the driving force of the air cylinder 28. In this case, in the pressure reducing chamber 17, the suction valve 19 and the exhaust valve 21 are respectively in "close" and "open" states; while in the pressure reducing chamber 18, the suction valve 20 and the exhaust valve 22 are respectively in "open" and "close" states. Under these conditions, if the piston 16*a* is moved in the direction of the arrow $a_1$, then the volume of the pressure reducing chamber 17 is decreased thereby to cause the refrigerant therein to be discharged through the exhaust valve 21, while the volume of the pressure reducing chamber 18 is increased thereby to introduce thereinto the gaseous refrigerant through the suction valve 20 from the refrigerant tank 11. The refrigerant should be discharged in the process of reducing the volume of the pressure reducing chamber 17 in such a manner that the pressure applied to the gaseous refrigerant is minimized. It is preferable that the sectional area of the opening of the exhaust outlet 21 is larger than that of the suction outlet 19. The same thing can be applied to the pressure reducing chamber 18.

The temperature of the refrigerant discharged from the exhaust outlet 21 becomes 30° to 40° C., and further becomes approximately 20° C. by air cooling (or water cooling) when passing through the heat exchanger 23. The refrigerant thus cooled is allowed to flow into the pressure cushioning tank 24. Accordingly, the refrigerant in liquid state is stored in this tank 24, and the refrigerant in gas state is mainly delivered toward the refrigerant flow control valve 26 which is opened and closed at the predetermined time intervals. During the opening period of the control valve 26, a predetermined amount of refrigerant is jetted through the throttle valve 25 into the expansion chamber 12. Then, the temperature of the expansion chamber is caused to be lower than that of the refrigerant tank 11 as a result of the expansion, and accordingly the pressure of the former is caused to be lower than that of the latter. The refrigerant is allowed to flow along the inner wall of the expansion chamber 12 through the jet nozzle 25*a* thereby to form an eddy current. By the formation of this eddy current, the pressure at the peripheral portion of the chamber is increased, while the pressure at the central portion thereof is decreased.

Because of this pressure difference in the chamber, the pressure of the gaseous refrigerant in the refrigerant tank 11 is increased through the small holes 13*a* of the separating plate 13, and the refrigerant liquid is sucked upward through the communicating pipe 14 protruded into the center of the eddy current, under a predetermined temperature condition. Then, the jetted refrigerant is mixed with the refrigerant liquid sucked into the expansion chamber 12, whereby the refrigerant liquid is cooled. This action is effected intermittently, at the predetermined time intervals, by the driving action of the control valve 26. The refrigerant liquid together with the refrigerant liquefied when jetted is allowed to flow into the tank 11 through the small holes 13*a* of the separating plate 13, as a result of which the temperature of the refrigerant liquid 15 in the refrigerant tank 11 is decreased. When the refrigerant is jetted, or the control valve is open, the suction valve 20 of the pressure reducing chamber 18 is in closed state.

On the other hand, when the secondary refrigerant passes through the heat exchanger 29 in the refrigerant tank 11, its thermal energy is transferred to the refrigerant liquid 15 in the refrigerant tank, as a result of which the temperature of the secondary refrigerant is caused to be lower. Upon receiption of the thermal energy from the secondary refrigerant, the temperature of the surface of the refrigerant liquid 15 is increased, as a result of which gaseous refrigerant is generated. This gaseous refrigerant is sucked into the pressure reducing chamber 17 through the suction valve 19 when the piston 16*a* of the pressure reducing cylinder 16 is moved in the direction of the arrow $a_1$. When the pressure reducing chamber 17 is in the suction state, the other chamber 18 is in the discharge state. In succession with this discharge process, the refrigerant is jetted into the expansion chamber 12 for a predetermined period of time, as a result of which the refrigerant suction and cooling operations are carried out similarly as in the above-described case.

Such an operation as described above is repeated in response to the reciprocation of the piston 16*a* of the pressure reducing cylinder 16, as a result of which the temperature of the refrigerant liquid in the refrigerant tank 11 is maintained low. Thus, a low temperature state is obtained under low pressure.

Any type of pump may be used for pumping the refrigerant liquid into the expansion chamber 12, if it can carry out the pumping operation in response to the intermittent jetting operation of the control valve 25 which is carried out at predetermined time intervals.

As is apparent from the above description, according to the invention, mainly the gaseous refrigerant is allowed to flow during the circulation cycle, and is jetted through the control valve at the predetermined time intervals to provide a low pressure state. Therefore, a relatively low pressure is maintained for all the processes of the circulation cycle, and accordingly the mechanical strengths of the various sections of the apparatus can be reduced, which lead to minaturization of the apparatus and to reduction in cost thereof. Furthermore, according to the invention, two pressure reducing chambers are provided on both sides of the piston of the cylinder, and the suction valves and exhaust valves of the pressure reducing chambers are operated alternately in a synchronization mode. Therefore, the low pressure is presented twice per receiprocation of the piston. This means that a low temperature can be provided with high efficiency. Furthermore, when the refrigerant is jetted into the expansion chamber, the eddy current is formed therein, and the pumping action is effected by the utilization of the pressure difference between the pressure at the central portion of the chamber and that at the peripheral portion of the same. Accordingly, the refrigerant liquid can be cooled without providing a pump.

What is claimed is:

1. An apparatus for liquefying refrigerant and generating a low temperature, which comprises; a refrigerant tank for storing refrigerant; and an expansion chamber communicated with said refrigerant tank, said refrigerant being jetted into said expansion chamber through valve means which is intermittently opened and closed at predetermined time intervals to liquefy refrigerant gas and to cool the refrigerant liquid in said refrigerant tank, said expansion chamber is cylindrical, one end portion of said pipe communicating said refrigerant tank with said expansion chamber is protruded to the central portion of said expansion chamber, said pipe thus protruded having relatively small holes in the wall of the protruded portion thereof, and the jet nozzle of said control valve is arranged along the inner wall of said expansion chamber so as to form an eddy current when refrigerant gas is jetted therethrough.

2. An apparatus as claimed in claim 1, which comprises: a refrigerant tank for storing refrigerant liquid; a control valve for expanding refrigerant gas; a refrigerant flow control valve for intermittently supplying refrigerant gas to said control valve at predetermined time intervals; an expansion chamber for receiving refrigerant gas jetted through said control valve; and a pipe having a length which provides a necessary temperature gradient and communicating said refrigerant tank with said expansion chamber.

3. An apparatus for liquefying refrigerant and generating a low temperature, which comprises: a refrigerant tank for storing refrigerant liquid; and expansion chamber provided above said refrigerant tank and communicated with said refrigerant tank; a pressure reducing chamber communicated with said refrigerant tank, for sucking gaseous refrigerant; a refrigerant cooling section for cooling gaseous refrigerant discharged from said pressure reducing chamber; a control valve for jetting cooled refrigerant through a predetermined opening into said expansion chamber; a refrigerant flow control valve provided upstream of said control valve, said refrigerant flow control valve being opened and closed at predetermined time intervals; and a heat exchanger for allowing secondary refrigerant to pass therethrough whose temperature is decreased by transferring the thermal energy thereof to the refrigerant liquid in said refrigerant tank.

4. An apparatus as claimed in claim 3, which comprises: a refrigerant tank for storing refrigerant liquid; an expansion chamber provided above said refrigerant tank so as to communicate with said refrigerant tank; a pressure reducing cylinder having a piston, and two pressure reducing chambers provided on both sides of said piston, each of said pressure reducing chamber being communicated through a suction valve with said refrigerant tank to suck in gaseous refrigerant therefrom; a refrigerant cooling section communicated respectively through exhaust valves with said pressure reducing chambers in said pressure reducing cylinder, for cooling gaseous refrigerant discharged from said pressure reducing chambers; a control valve for jetting cooled refrigerant through a predetermined opening into said expansion chamber; a refrigerant flow control valve provided upstream of said control valve, said refrigerant flow control valve being opened and closed at predetermined time intervals; and a heat exchanger for allowing secondary refrigerant to pass therethrough whose temperature is decreased by transferring the thermal energy thereof to the refrigerant liquid in said refrigerant tank, and in which while refrigerant is sucked into one of said pressure reducing chambers, the refrigerant is discharged out of the other pressure reducing chamber.

5. An apparatus as claimed in claim 3, which comprises: a refrigerant tank for storing refrigerant liquid; a cylindrical expansion chamber provided on said refrigerant tank, said expansion chamber being separated from said refrigerant tank by means of a separating plate having relatively small holes in the peripheral portion thereof, said expansion chamber being communicated with said refrigerant tank by means of a communicating pipe penetrating the central portion of said separating plate; a pressure reducing chamber communicated with said refrigerant tank to suck in gaseous refrigerant; a refrigerant cooling section for cooling gaseous refrigerant discharged out of said pressure reducing chamber; a control valve for jetting cooled refrigerant through a predetermined opening into said expansion chamber; a refrigerant flow control valve provided upstream of said control valve, said refrigerant flow control valve being opened and closed at predetermined time intervals; and an heat exchanger for allowing secondary refrigerant to pass therethrough whose temperature is decreased by transferring the thermal energy thereof to the refrigerant liquid in said refrigerant tank, the jet nozzle of said control valve being so arranged along the inner wall of said expansion chamber that when refrigerant is jetted therethrough, an eddy current is formed in said expansion chamber.

* * * * *